United States Patent [19]

Tachikawa et al.

[11] 4,426,572

[45] Jan. 17, 1984

[54] HEATING APPARATUS WITH CHAR DETECTING AND HEATING CONTROL UNIT

[75] Inventors: Hajime Tachikawa, Fujisawa; Masahiro Ishihara, Yokohama, both of Japan

[73] Assignee: Hitachi Heating Appliances Co., Ltd., Chiba, Japan

[21] Appl. No.: 268,373

[22] Filed: May 29, 1981

[30] Foreign Application Priority Data

May 10, 1979 [JP] Japan ..... 54-57483
May 10, 1979 [JP] Japan ..... 54-57484
May 10, 1979 [JP] Japan ..... 54-57485

[51] Int. Cl.[3] ..... H05B 1/02

[52] U.S. Cl. ..... 219/502; 219/10.55 B; 219/497; 374/9

[58] Field of Search ..... 219/10.55 B, 502, 497, 219/494, 501, 507–509; 73/355 R, 355 EM, 356; 307/117

[56] References Cited

U.S. PATENT DOCUMENTS

| | | | |
|---|---|---|---|
| 3,371,268 | 2/1968 | Knudsen | 219/502 |
| 4,180,722 | 12/1979 | Clewans | 219/497 |
| 4,213,023 | 7/1980 | Satoh et al. | 219/10.55 B |
| 4,238,672 | 12/1980 | Siess | 219/497 |
| 4,245,148 | 1/1981 | Gisske et al. | 219/502 |
| 4,363,957 | 12/1982 | Tachikawa et al. | 219/502 |

*Primary Examiner*—M. H. Paschall
*Attorney, Agent, or Firm*—Antonelli, Terry & Wands

[57] ABSTRACT

A heating apparatus in which an object to be heated placed in its heating chamber can be heated until the surface of the object is charred as desired by the user. A first photo sensor senses the intensity of light of visible spectrum range directed toward and reflected from the surface of the object being heated, and a second photo sensor senses the light intensity related to the light reflected from the surface of the object, that is, at least one of the intensity of illuminating light emitted from a light source and the intensity of illuminating light coming from the exterior of the heating chamber. The degree of charring of the surface of the object is judged on the basis of the output signals from the first and second photo sensors, and the heating operation is controlled on the basis of the result of judgement.

11 Claims, 14 Drawing Figures

HEATING APPARATUS WITH CHAR DETECTING AND HEATING CONTROL UNIT

This invention relates to heating apparatus including a heat source disposed inside or outside of its heating chamber in which an object to be heated is placed so that the surface of he object can be charred as desired, and more particularly to an apparatus of the kind described above which comprises a char detecting and heating control unit which detects the degree of charring of the surface of an object being heated thereby automatically changing the mode of heating so that the object can be properly heated.

In a heating apparatus such as an electric oven, a gas oven (or grill) or an oven range, hot gas or infrared radiation generated by actuation of a heat source such as an electric heater, or a gas burner is supplied into its heating chamber to heat an object to be heated placed in the heating chamber. In such a heating apparatus, means such as a timer is used for controlling the timing of completing heating of the object placed in the heating chamber, and the user determined the duration of heating by manipulating the timer to achieve the desired finish. Due to, however, the fact that the optimum duration of heating for achieving the desired finish is variable depending on the factors including the amount, water content, composition and shape of an object to be heated in the heating chamber, considerable skill is required for setting the optimum duration of heating, and improper setting of the heating duration resulted frequency in overheating or underheating of the object. An improvement which obviates the above defect has been proposed according to which a lamp emitting light of visible spectrum range and directing it toward an object being heated in the heating chamber is provided, and a photo sensor sensing the intensity of light reflected from the surface of the object being heated is provided to detect the degree of charring of the surface of the object on the basis of a change in the intensity of reflected light, so that heating by, for example, the electric heater can be stopped as soon as the surface of the object being heated is charred to the desired degree.

In the conventional heating apparatus, however, the primary part of light incident upon the object being heated is illuminating light emitted from a lamp, and the secondary part thereof is external light admitted through a view window formed in a door. Therefore, a photo sensor has been unable to accurately sense the degree of charring of the surface of the object being heated when illuminating light emitted from the lamp is subject to a variation, and the duration of heating has inevitably fluctuated over a range of values.

It is therefore a primary object of the present invention to provide a novel and improved heating apparatus which obviates the prior art deflects pointed out above and which can automatically control the degree of charring of the surface of an object being heated so as to char such a surface to the desired finish conforming with the condition of heating when it is preset.

According to the present invention, in order to attain the above object, there is provided a heating apparatus which comprises a heating chamber, heating means capable of heating an object to be heated placed in the heating chamber until the surface of the object is charred to a given extent, light source means for emitting light of visible spectrum range to illuminate the surface of the object placed in the heating chamber, first photo sensor means for sensing the intensity of light reflected from the surface of the object, second photo sensor means for sensing the light intensity related to the light illuminating the surface of said object, means responsive to the outputs from the first and second sensor means for judging the degree of charring of the surface of the object, and means responsive to the output from the judging means for controlling the heating operation of the heating means.

The present invention will be described with reference to the accompanying drawings, in which.

Figure 1:
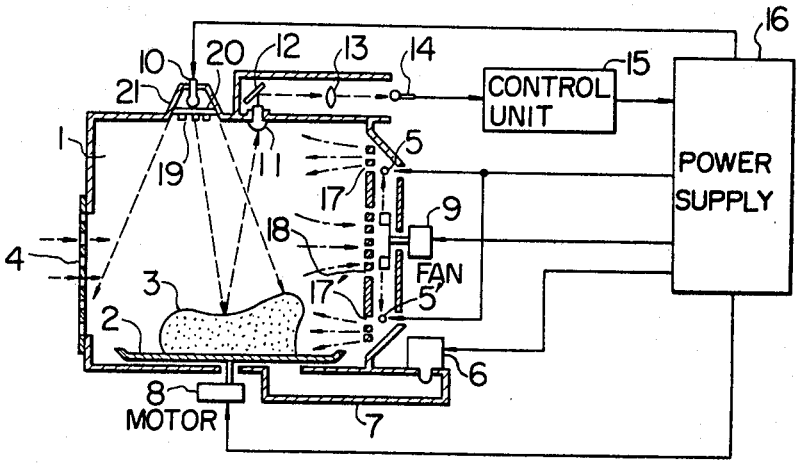
FIG. 1 PRIOR ART
FIG. 1 shows schematically the structure of one form of the prior art heating apparatus.

For a better understanding of the present invention, the structure of the prior art heating apparatus will be described with reference to FIG. 1 before describing the present invention in detail. Referring to FIG. 1, a door 4 formed with a view window is opened, and an object 3 to be heated is placed on a turntable 2 in a heating chamber 1. When a power supply 16 is energized after closing the door 4, a lamp 10 disposed in a lamp housing 21 emits light of visible spectrum range which is directed through a sheet 22 of heat-resistive glass and through a plurality of punchings 19 provided in the upper wall of the heating chamber 1 toward the object 3 to illuminate the same. Light reflected from the object 3 to be heated is directed toward a photo sensor 14 through a condenser 11, a mirror 12 and a lens 13, and the signal indicative of the intensity of light reflected from the object 3 and sensed by the photo sensor 14 is applied from the photo sensor 14 to a control unit 15. In the meantime, electric heaters 5, 5' and a fan 9 start to operate to supply hot air into the heating chamber 1 through inlet perforations 17 and 17'. The stream of hot air is then discharged through outlet perforations 18 to be recirculated. The object 3 placed on the turntable 2 in the heating chamber 1 is heated by such a circulating stream of hot air. A motor 8 for turning the turntable 2 is energized at the same time to prevent non-uniform heating of the object 3. As the surface of the object 3 is progressively charred by the heat provided by hot air, the intensity of reflected light sensed by the photo sensor 14 is gradually lowered. When the intensity of reflected light sensed by the photo sensor 14 attains a predetermined setting, the control unit 15 applies a deenergizing signal to the power supply 16. In response to the application of this deenergizing signal to the power supply 16, the electric heaters 5, 5', fan 9, motor 8 and lamp 10 are deenergized, to complete heating of the object 3.

The heating apparatus shown in FIG. 1 includes a high-frequency or microwave oscillating tube 6 and a waveguide 7 known in the art. In FIG. 1, the beams of light are indicated by the broken lines, and the streams of hot air are indicated by the one-dot chain lines. Although not shown in FIG. 1 to avoid confusion of illustrtion, a temperature sensor is provided to control the temperature of hot air. In response to the application of the output signal from the temperature sensor, the control unit 15 controls the electric heaters 5 and 5' through the power supply 16 so as to maintain the temperature of hot air at a predetermined setting.

This conventional heating apparatus has such a defect as mentioned above. For example, on-off of the electric heaters 5 and 5' gives rise to a level variation of several volts in the power supply voltage applied across the lamp 10, and, because of such a variation in the power supply voltage, the intensity of illuminating light emitted from the lamp 10, the intensity of light reflected from the surface of the object 3 being heated and the intensity of light incident upon the photo sensor 14 are inevitably subject to variations. Further, the intensity of external light admitted through the view window of the door 4 is also subject to a variation due to, for example, on-off of a lamp in the room, with a result that the intensity of light reflected from the surface of the object 3 being heated and the intensity of light incident upon the photo sensor 14 are also similary subject to variations. When the electric heaters 5 and 5' are denergized, the intensity of illuminating light emitted from the lamp 10 increases, and, when the lamp in the room is turned on, the intensity of external light admitted through the view window of the door 4 increases too. Thus, when these phenomena occur during the process of charring control on the basis of the output signal from the photo sensor 14, the intensity of light reflected from the object 3 being heated increases or more light is reflected therefrom. In such a case, the photo sensor 14 may sense that retrogression has occurred on the state of charring, and the duration of heating may be extended beyond the optimum value.

Preferred embodiments of the present invention will now be described with reference to the drawings.

Figure 2:
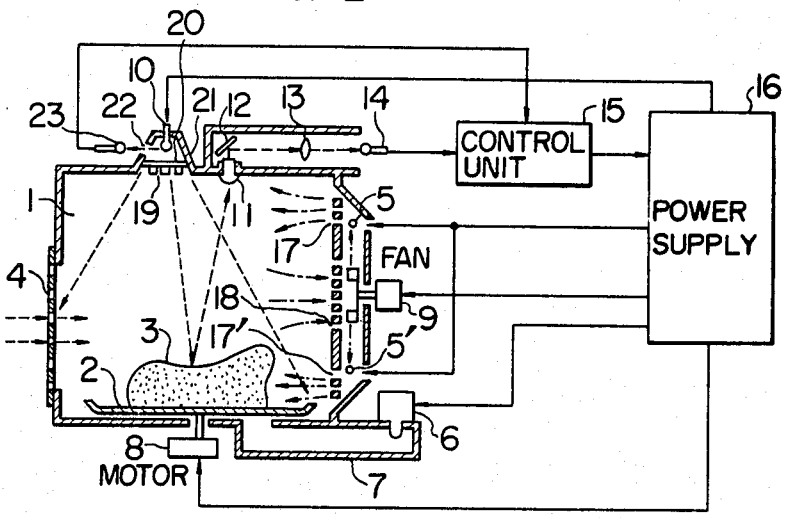
FIG. 2 shows schematically the structure of an embodiment of the heating apparatus according to the present invention.

FIG. 2 is a schematic sectional view of a embodiment of the heating apparatus of the present invention which includes a photo sensor for sensing the intensity of light emitted from light source means. In FIG. 2, the same reference numerals are used to designate the same parts appearing in FIG. 1.

Referring now to FIG. 2, a hole 22 is bored in the side wall of the lamp housing 21, and a photo sensor 23 is provided to sense the intensity of illuminating light of visible spectrum range which is emitted from the lamp 10 and led out through this hole 22. When now the door 4 is opened, an object 3 to be heated is placed on the turntable 2, and the power supply 16 is energized after closing the door 4, the lamp 10 emits light to illuminate the object 3 to be heated. Light reflected from the surface of the object 3 to be heated is directed toward the first photo sensor 14 through the condenser 11, mirror 12 and lens 13, and the signal indicative of the intensity of reflected light is applied from the first photo sensor 14 to the control unit 15. The second photo sensor 23 senses the intensity of illuminating light emitted from the lamp 10, and the signal indicative of the intensity of illuminating light is applied from the second photo sensor 23 to the control unit 15. While compensating any variation of the intensity of illuminating light emitted from the lamp 10 on the basis of the output signal from the second photo sensor 23, the control unit 15 stores the light intensity signal (the signal indicative of the intensity of light reflected from the object 3) applied from the first photo sensor 14 to utilze it for the control of the power supply 16. In the meantime, the electric heaters 5, 5' and the fan 9 start to operate to supply hot air into the heating chamber 1 through the inlet perforations 17 and 17'. The stream of hot air is then discharged through the outlet perforations 18 to be recirculated. The object 3 placed on the turntable 2 in the heating chamber 1 is heated by such a circulating stream of hot air. The motor 8 for turning the turntable 2 is energized at the same time to prevent non-uniform heating of the object 3. As the surface of the object 3 is progressively charred by the heat provided by the hot air, the intensity of reflected light sensed by the first photo sensor 14 is gradually lowered in a relation proportional to the degree of charring. When the intensity of reflected light sensed by the first photo sensor 14 attains a predetermined setting, the control unit 15 applies a deenergizing signal to the power supply 16. In response to the application of this deenergizing signal to the power supply 16, the electric heaters 5, 5', fan 9, motor 8 and lamp 10 are deenergized to complete heating of the object 3.

Figure 3:
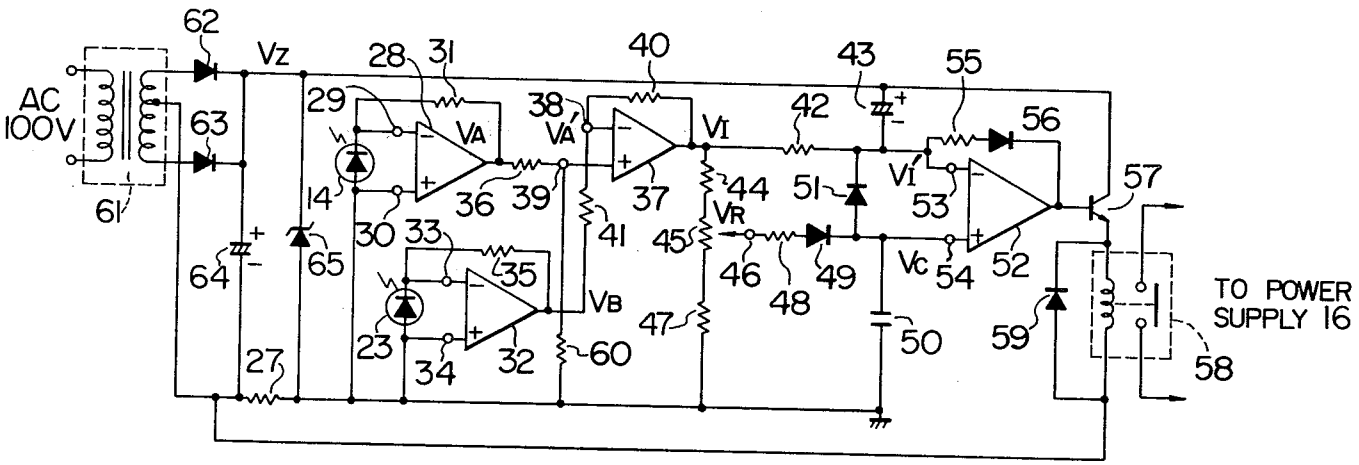
FIG. 3 is a circuit diagram showing the practical structure of one form of the control unit employed in the heating apparatus of the present invention shown in FIG. 2.

The practical structure of one form of the control unit 15 shown in FIG. 2 will be described with reference to FIG. 3. Referring now to FIG. 3, the first photo sensor 14 sensing the intensity of light (indicative of the degree of charring) reflected from the surface of the object 3 being heated is in the form of a photo diode provided with a visible light filter. The second photo sensor 23 sensing the intensity of illuminating light emitted from the lamp 10 is in the form of a photo diode.

An AC voltage of 100 volts, for example, is applied across the primary winding of a transformer 61 to induce an AC voltage across the secondary winding of the transformer 61. After rectifiying this AC voltage by diodes 62, 63 and smoothing the rectified voltage by a capacitor 64, the DC voltage is applied across a Zener diode 65 and a resistor 27. A stabilized voltage $V_Z$ appears across the Zener diode 65. The photo diode 14 is connected across a negative input terminal 29 and a positive input terminal 30 of an operational amplifier 28, to generate a photocurrent porportional to the intensity of light reflected from the surface of the object 3 depending on the degree of charring. It is apparent that the value of this photocurrent is larger when the intensity of reflected light is higher. The voltage representing the product of the value of this photocurrent and the resistance of a negative feedback resistor 31 appears at the output terminal of the operational amplifier 28. This output voltage is an electrical signal indicative of the result of detection of the degree of charring of the surface of the object 3. Such an output voltage decreases when the intensity of light reflected from the surface of the object 3 is lowered, since the value of the photocurrent of the photo diode 14 is small in such a case. This output voltage will be referred to hereinafter as a charring detection voltage $V_A$. This charring detection voltage $V_A$ is divided by resistors 36 and 60, and the divided voltage $V_A'$ is then applied to a positive input terminal 39 of a second operational amplifier 37.

The photo diode 23 is connected across a negative input terminal 33 and a positive input terminal 34 of a third operational amplifier 32 to generate a photocurrent proportional to the intensity of illuminating light emitted from the lamp 10. As described above, the value of this photocurrent is also larger when the intensity of illuminating light is higher. The voltage representing the product of the value of this photocurrent and the resistant of a negative feedback resistor 35 appears at the output terminal of the third operational amplifier 32. This output voltage will be referred to hereinafter as a lamp light detection voltage $V_B$. This lamp light intensity detection voltage $V_B$ is applied through a resistor 41 to the negative input terminal 38 of the second operational amplifier 37. A negative feedback resistor 40 is connected between the output terminal and the negative input terminal 38 of the second operational amplifier 37. It is so selected that the relation $V_B < V_A$ holds between the lamp light intensity detection voltage $V_B$ and the charring detection voltage $V_A$. The second operational amplifier 37 amplifies the difference $(V_A - V_B)$ by the factor determined by the resistance values of the resistors 36, 60, 40 and 41 and provides an output voltage $V_I$. Therefore, this output voltage $V_I$ corresponds to the charring detection voltage $V_B$ obtained after compensation of the variation of the intensity of illuminating light emitted from the lamp 10. It will be seen that, when the intensity of illuminating light emitted from the lamp 10 varies, the intensity of light reflected from the object 3 being heated varies also in the same direction as the direction of variation of the intensity of illuminating light emitted from the lamp 10. This voltage $V_I$ will be referred to hereinafter as a charring detection voltage $V_I$. This charring detection voltage $V_I$ is applied to a positive input terminal 53 of a comparator 52 through a low-pass filter composed of a resistor 42 and a capacitor 43 connected at its positive plate to the Zener diode 65 providing the stabilized voltage $V_Z$. The voltage $V_I'$ applied to the positive input terminal 53 of the comparator 52 will also be referred to hereinafter as a charring detection voltage like the voltages $V_A$ and $V_I$.

The charring detection voltage $V_I$ is also applied to a series circuit of resistors 44, 47 and a potentiometer 45, and a voltage $V_R$ obtained by dividing the voltage $V_I$ appears at an intermediate terminal 46 of the potentiometer 45. This divided voltage $V_R$ is applied through a current-limiting resistor 48 to a capacitor memory circuit composed of a diode 49 and a capacitor 50. The capacitor 50 stores the substantially maximum value of the voltage $V_R$ so as to apply a reference voltage $V_C$ to a negative input terminal 54 of the comparator 52. A diode 51 is connected between the two input terminals 53 and 54 of the comparator 52 so as to compensate leakage current of the diode 49 and to permit discharge of the capacitor 50. The comparator 52 compares the input voltage $V_I'$ with the reference voltage $V_C$ and applies an output voltage of high level to the base of a transistor 57 when the relation $V_I' > V_C$ holds. On the other hand, the comparator 52 applies an output voltage of low level to the base of the transistor 57 when the relation $V_I' < V_C$ holds. A series circuit of a resistor 55 and a diode 56 is connected between the positive input terminal 53 and the output terminal of the comparator 52 for the positive feedback purpose so that, when the output voltage of the comparator 52 turns from its high level to its low level, that level can be maintained. The transistor 57 is connected at its collector to the stabilized voltage $V_Z$ and at its emitter to the primary coil of a relay 58 to act as an emitter follower. Therefore, a voltage whose level is substantially the same as that of the output voltage of the comparator 52 is applied across the primary coil of the relay 58. A voltage of high level appears at the emitter of the transistor 57 when the output voltage of high level appears from the comparator 52, and current flows through the primary coil of the relay 58 to turn on the secondary contact of the relay 58. On the other hand, the secondary contact of the relay 58 is turned off when the output voltage of low level appears from the comparator 52. This secondary contact of the relay 58 is connected to the power supply 16 to control the power supply 16. It is so arranged that the power supply 16 is energized when the secondary contact of the relay 58 is turned on. A diode 59 is connected in parallel with the primary coil of the relay 58 to prevent flow of current into the primary coil of the relay 58 when the emitter voltage of the transistor 57 turns into its low level from its high level. The input-part element of each of the operational amplifiers 28, 32, 37 and comparator 52 is in the form of an MOS.FET.

In operation, an object 3 to be heated is placed on the turntable 2 in the heating chamber 1 and, after closing the door 4, a start button (not shown) on the panel is depressed to apply the AC voltage of 100 volts across the primary winding of the transformer 61. The DC voltage appears across the capacitor 64, and the stabilized voltage $V_Z$ appears across the Zener diode 65. At this time, the capacitors 43 and 50 are short-circuited in the AC sense. Further, because of the fact that the reference voltage $V_C$ provided by the resistors 44, 47 and potentiometer 45 is selected to be lower than the charring detection voltage $V_I'$, the comparator 52 is generating the output voltage of high level at this time. Therefore, the high level appears at the emitter of the transistor 57, and current flows through the primary coil of the relay 58 to turn on the secondary contact of the relay 58. Consequently, the power supply 16 is energized to energize the lamp 10, and the lamp 10 emits light illuminating the object 3 to be heated. The fan 9, electric heaters 5, 5' and turntable drive motor 8 start to operate at the same time. The photo diode 23 senses the intensity of illuminating light emitted from the lamp 10, and its photocurrent shows a great increase to increase the lamp light intensity detection voltage $V_B$. At the same time, the photocurrent of the photo diode 14 sensing the intensity of light reflected from the surface of the object 3 being heated shows also a great increase to increase the charring detection voltage $V_A$. The charring detection voltage $V_I$ increases also since the second operational amplifier 37 amplifies the difference $(V_A - V_B)$ between the voltages $V_A$ and $V_B$. The capacitor 50 is charged through the diode 49.

As the surface of the object 3 being heated is progressively charred, the intensity of light reflected from the surface of the object 3 is gradually lowered, and the photocurrent of the photo diode 14 decreases gradually. Consequently, the charring detection voltage $V_I$ decreases also gradually. Since the voltage $V_R$ decreases also similarly, the diode 49 is finally cut off, and the reference voltage $V_C$ is stored in the capacitor 50. When the level of the charring detection voltage $V_I'$ becomes lower than that of the reference voltage $V_C$ with progressive charring of the surface of the object 3 being heated, the voltage of high level having been applied from the comparator 52 to the base of the transistor 57 is turned into its low level. This voltage of low level is maintained by the positive feedback circuit composed of the resistor 55 and the diode 56. The emitter voltage of the transistor 57 is now in its low level since the base voltage turns into its low level. Consequently, no current flows through the primary coil of the relay 58, and the secondary contact of the relay 58 is turned off to turn off the power supply 16. Thus, the electric heaters 5, 5', lamp 10, fan 9 and motor 8 are deenergized to complete heating of the object 3.

Although not shown, a second secondary contact of the relay 58 is connected in parallel with the contact of the aforementioned start button on the panel. Thus, when the user depresses the start button, the second secondary contact of the relay 58 is turned on in the manner described above, so that the AC voltage of 100 volts can be continuously applied across the primary winding of the transformer 61 even when the user ceases to depress the start button. Upon completion of heating, the second secondary contact of the relay 58 is turned off to release application of the AC voltage of 100 volts across the primary winding of the transformer 61.

Figure 4:
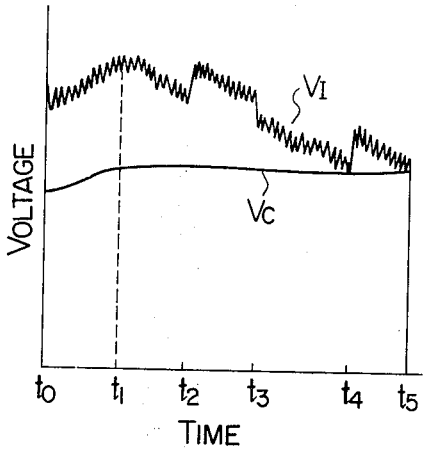
FIG. 4 is a graph showing the relation between the charring detection voltage and the reference voltage relative to time in the absence of the photo sensor provided in FIG. 3 for compensating a variation of the intensity of light emitted from the light source.
Figure 5:
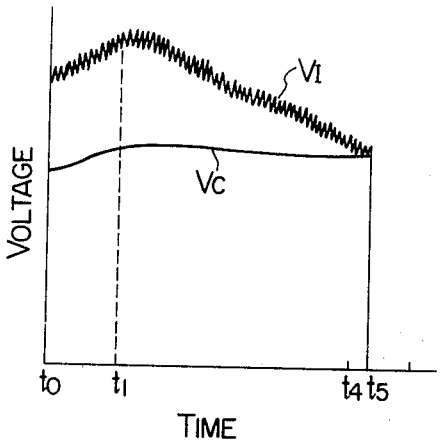
FIG. 5 is a graph similar to FIG. 4 but showing the above relation in the presence of the intensity variation compensation photo sensor.

The photo diode 23 acts to compensate a variation of the intensity of illuminating light emitted from the lamp 10, as described above. This compensation effect will now be discussed in more detail. FIG. 4 is a graph showing the relation between the charring detection voltage $V_I$ and the reference voltage $V_C$ relative to time in the case where the photo diode 23 and its peripheral circuit shown in FIG. 3 are not provided, that is, in the case where, for example, the resistor 41 is connected to the input terminal 34 of the third operational amplifier 32 instead of being connected to the output terminal of the operational amplifier 32. FIG. 5 is a graph showing also the relation between the voltages $V_I$ and $V_C$ relative to time in the case of FIG. 3 where the photo diode 23 and its peripheral circuit are provided. The horizontal axis represents time in FIGS. 4 and 5.

Referring first to FIG. 4, the charring detection voltage $V_I$ increases slightly after time $t_0$ ($\div 0$) at which heating of the object 3 is started. At time $t_1$, the voltage $V_I$ attains a peak and then decreases gradually as the surface of the object 3 being heated starts to be charred. At this time, the reference voltage $V_C$ is maintained at a value substantially equal to the peak value of the voltage $V_R$. However, this reference voltage $V_C$ is not maintained constant in a strict sense. The reason therefor will be described in detail later.

When the electric heaters 5 and 5' are turned off at time $t_2$ after time $t_1$ for the adjustment of the internal temperature of the heating chamber 1, the AC power supply voltage varies to increase the intensity of illuminating light emitted from the lamp 10. This is attributable to a reduction of the voltage drop due to the resistance components of the feeders, and a similar phenomenon appears when an apparatus, which is disposed separately from the heating apparatus and consumes a large amount of current, is turned off. Consequently, the intensity of light reflected from the object 3 being heated increases too to increase the charring detection voltage $V_I$. Then, the charring detection voltage $V_I$ varies in a manner as shown in FIG. 4 when the electric heaters 5 and 5' are turned on at time $t_3$, turned off at time $t_4$ and turned on again at time $t_5$. Therefore, the time at which the reference voltage $V_C$ exceeds the charring detection voltage $V_I$ tends to fluctuate due to the repeated on-off of the electric heaters 5 and 5', resulting in unsatisfactory control performance. In contrast, FIG. 5 shows that the voltage $V_I$ is free from level variations as shown in FIG. 4 by virtue of provision of the photo diode 23 and its peripheral circuit. It will thus be seen that the provision of the photo sensor 23 sensing a variation of the intensity of light emitted from the light source means (the lamp 10) and compensating such an intensity variation can effectively improve the control performance.

Figure 6:
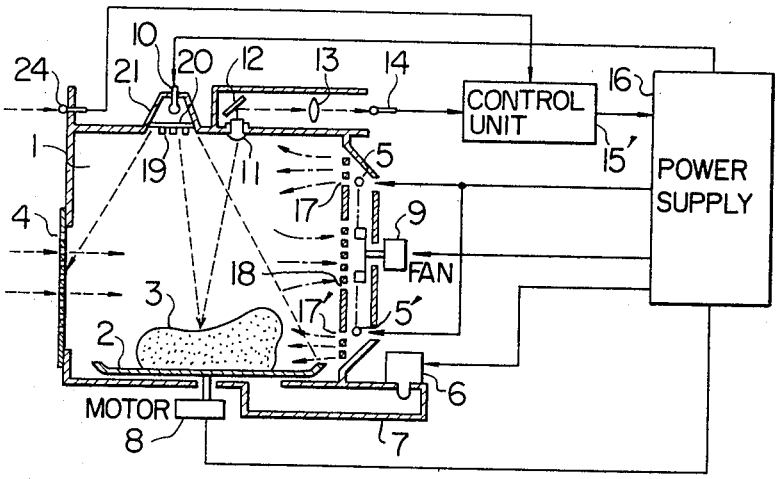
FIG. 6 shows schematically the structure of another embodiment of the heating apparatus according to the present invention.

FIG. 6 is a schematic sectional view of another embodiment of the heating apparatus of the present invention which includes a second photo sensor for sensing the intensity of external ight. In FIG. 6, the same reference numerals are used to designate the same parts appearing in FIG. 1.

Referring to FIG. 6, a second photo sensor 24 senses the intensity of external light and applies its output signal to a control unit 15'. Since the structure and operation of the heating apparatus shown in FIG. 6 are generally similar to those of the heating apparatus shown in FIGS. 1 and 2, the differences will only be described. The first photo sensor 14 applies its output signal indicative of the intensity of light reflected from an object 3 to be heated to the control unit 15', and the second photo sensor 24 applies its output signal indicative of the intensity of external light to the control unit 15'. While compensating any variation of the intensity of external light on the basis of the output signal from the second photo sensor 24, the control unit 15' stores the light intensity signal (the signal indicative of the intensity of light reflected from the object 3) applied from the first photo sensor 14 to utilize it for the control of the power supply 16.

Figure 7:
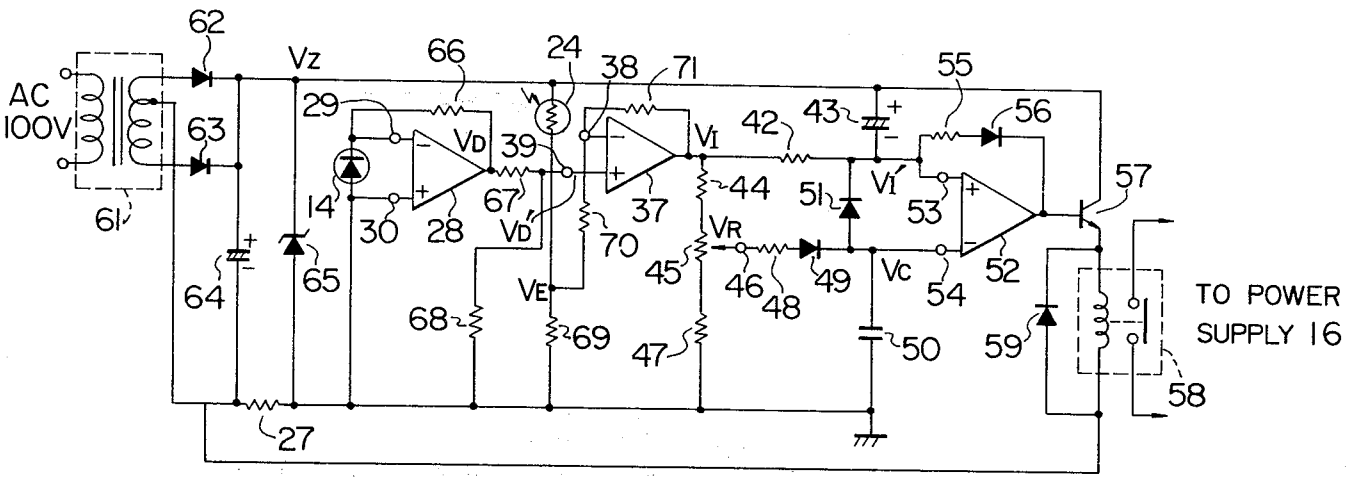
FIG. 7 is a circuit diagram showing the practical structure of one form of the control unit employed in the heating apparatus of the present invention shown in FIG. 6.

The practical structure of one form of the control unit 15' shown in FIG. 6 will be described with reference to FIG. 7. In FIG. 7, the same reference numerals are used to designate the same parts appearing in FIG. 3. Since the structure and operation of this circuit are generally similar to those described with reference to FIG. 3, only the differences will be described to avoid repetition of the same explanation. Referring now to FIG. 7, the second photo sensor 24 sensing the intensity of light external to the heating chamber 1 is in the form of a photoconductive cell of CdS which will be abbreviated hereinafter as a CdS. A voltage representing the product of the value of the photocurrent of the photo diode 14 and the resistance of a negative feedback resistor 66 associated with the operational amplifier 28 appears at the output terminal of the operational amplifier 28. This output voltage will be referred to hereinafter as a charring detection voltage $V_D$. This charring detection voltage $V_D$ is divided by resistors 67 and 68, and the divided voltage $V_D'$ is then applied to the positive input terminal 39 of the second operational amplifier 37.

The stabilized voltage $V_Z$ is also divided by the CdS 24 and a resistor 69 to provide a voltage $V_E$. This voltage $V_E$ varies in proportion to the resistance value of the CdS 24 which varies in proportion to the intensity of external light. (The greater the intensity of external light, the resistance value of the CdS 24 becomes smaller.) This voltage $V_E$ will be referred to hereinafter as an external light intensity detection voltage $V_E$. This external light intensity detection voltage $V_E$ is applied through a resistor 70 to the negative input terminal 38 of the second operational amplifier 37. A negative feedback resistor 71 is connected between the output terminal and the negative input terminal 38 of the second operational amplifier 37. It is so selected that the relation $V_E < V_D$ holds between the external light intensity detection voltage $V_E$ and the charring detection voltage $V_D$. The second operational amplifier 37 amplifies the difference $(V_D - V_E)$ by the factor determined by the resistance values of the resistors 67, 68, 70 and 71 and provides an output voltage $V_I$. Therefore, this output voltage $V_I$ corresponds to the charring detection voltage $V_D$ obtained after compensation of the variation of the intensity of external light. It will be seen that, when the intensity of external light varies, the intensity of light reflected from the object 3 being heated varies also in the same direction as the direction of variation of the intensity of external light. This voltage $V_I$ is then processed in a manner similar to that described with reference to FIG. 3, and any description explaining the manner of processing will be unnecessary. Herein, the difference from the operation of the circuit shown in FIG. 3 will only be described.

In operation, the lamp 10 is energized to illuminate the object 3 as soon as heating is started. The photo diode 14 senses the intensity of light reflected from the object 3 being heated, and its photocurrent shows a great increase to increase the charring detection voltage $V_D$. On the other hand, the CdS 24 senses the intensity of external light to provide the external light intensity detection voltage $V_E$. The second operational amplifier 37 amplifies the difference $(V_D - V_E)$ between the voltages $V_D$ and $V_E$ to increase the charring detection voltage $V_I$. Subsequent operation of the circuit is similar to that described with reference to FIG. 3.

Figure 8:
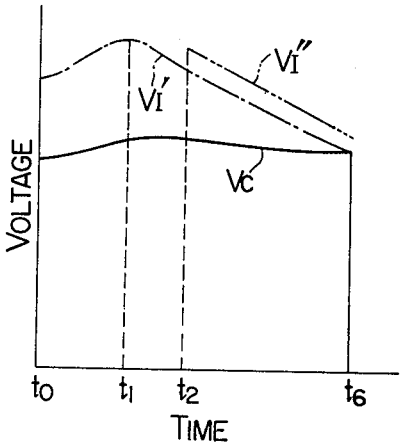
FIG. 8 is a graph showing the effect of intensity variation compensation by the photo sensor provided in FIG. 6 for sensing the intensity of external light.

The CdS 24 acts to compensate a variation of the intensity of external light, as described above. This compensation effect will now be discussed. FIG. 8 is a graph showing the relation between the charring detection voltage $V_I'$ and the reference voltage $V_C$ relative to time. The horizontal axis represents time in FIG. 8. Referring to FIG. 8, the charring detection voltage $V_I'$ (shown by the one-dot chain curve) increases slightly after time $t_0$ ($\div 0$) at which heating of the object 3 is started, although it is dependent upon the property of the object 3 to be heated. Such an increase occurs because the surface of the object 3 is dried or expands. With the increase in the charring detection voltage $V_I'$, the reference voltage $V_C$ (shown by the solid curve in FIG. 8) increases slightly also. At time $t_1$, the voltage $V_I'$ attains a peak and then decreases gradually as the surface of the object 3 being heated starts to be charred. At this time, the reference voltage $V_C$ is maintained at a value substantially equal to the peak value of the voltage $V_R$. However, this reference voltage $V_C$ is not maintained constant in a strict sense. The reason therefor will be described in detail later.

At time $t_6$, the relation $V_I' < V_C$ holds, and the heating operation is completed. At this time, both of the voltages $V_I'$ and $V_C$ are subject to an abrupt drop by the action of the comparator 52, resistor 55 and diode 56. If the CdS 24 functioning to compensate a variation of the intensity of external light were not provided, the level of the voltage $V_I'$ ($V_I$) would be varied by the influence of the intensity of light entering the heating chamber 1 through the view window of the door 4. The voltage $V_I''$ (shown by the two-dot chain curve in FIG. 8) is the result of such level variations of the voltage $V_I'$. Thus, when a light source or a lamp disposed on the side of the door 4 and emitting light of relatively high intensity is turned on at time $t_2$, the level of the voltage $V_I'$ shifts to a higher level shown by the voltage $V_I''$, and this voltage $V_I''$ decreases gradually with progressive charring of the surface of the object 3 being heated. Therefore, the time at which the reference voltage $V_C$ exceeds the charring detection voltage $V_I''$ becomes later than when the voltage $V_C$ exceeds the voltage $V_I'$, resulting in unsatisfactory control performance. It will thus be seen that the provision of the photo sensor 24 sensing a variation of the intensity of external light entering the heating chamber 1 and compensating such an intensity variation can effectively improve the control performance.

Figure 9:
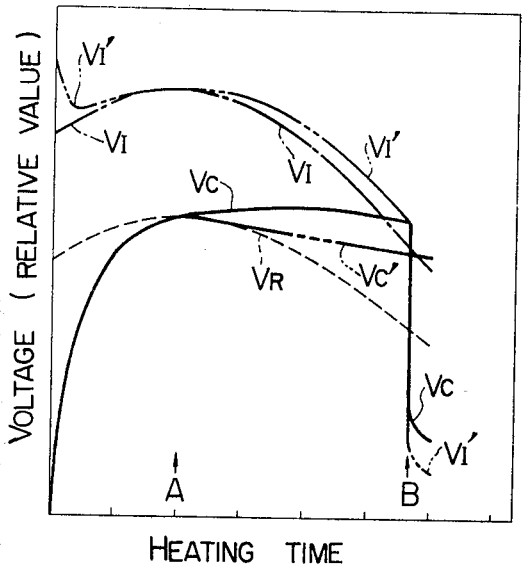
FIG. 9 is a graph showing, by way of example, the relative levels of the voltages $V_I$, $V_I'$, $V_R$ and $V_C$ shown in FIGS. 3 and 7.

The function of the diode 51 which compensates leakage current of the diode 49 will now be described. FIG. 9 is a graph showing, by way of example, the relative levels of the voltages $V_I$, $V_I'$, $V_R$ and $V_C$ varying relative to time when a hot cake is baked. Although the voltage $V_I$ includes noise resulting from, for example, level variations of the AC voltage of commercial frequency applied across the lamp 10, its central level is shown for the purpose of clarity. The voltage curve $V_C'$ shown in FIG. 9 represents variations of the voltage $V_C$ in the absence of the diode 51. Consider now the change in color of the surface of the hot cake. The surface of the hot cake is initially cream-colored at the starting time of heating. Such a cream-colored surface turns into white when dried by application of heat and then turns into cocoa brown with the progress of heating. Further heating causes charring of the surface of the hot cake, and the color changes into dark brown relatively rapidly. Thus, the intensity of light reflected from the surface of the hot cake and sensed by the photo diode 14 increases once after the starting time of heating and then decreases rapidly after attaining a peak. Therefore, as described hereinbefore and as illustrated in FIG. 9, the charring detection voltage $V_I$ increases once after the starting time of heating and then decreases after attaining a peak. On the other hand, the voltage $V_I'$, which is initially maintained at the level of the stabilized voltage $V_Z$ at the starting time of heating by the action of the capacitor 43 as described hereinbefore, approaches the voltage $V_I$ with the time constant determined by the capacitance value of the capacitor 43 and the resistance value of the resistor 42 until finally it attains the level of the voltage $V_I$. (In FIG. 9, the difference between these voltages $V_I'$ and $V_I$ is exaggerated to clarify the difference.) The voltage $V_R$ obtained by dividing the voltage $V_I$ varies in a substantially constant proportional relation with the voltage $V_I$ as shown in FIG. 9 by the action of the current-limiting resistor 48.

The reference voltage $V_C$ is initially zero volts since the capacitor 50 is not charged at the starting time of heating. The capacitor 50 is gradually charged with the progress of heating until the voltage $V_R$ attains a peak at time shown by the arrow A in FIG. 9. Such a level of the voltage $V_R$ is stored in the capacitor 50. After the time shown by the arrow A at which the voltage $V_C$ has been stored, the voltage $V_C$ increases gradually but slowly and then decreases. It is the influence of leakage currents of the diodes 51 and 49 that causes such a gradual variation of the reference voltage $V_C$ after the time A at which the voltage $V_C$ has been stored. The relation $V_I' > V_C \div V_R$ holds at the time at which the diode 49 is cut off, that is, the time at which the voltage $V_C$ is stored in the capacitor 50. The relation $V_I' > V_C > V_R$ holds thereafter, and, finally, the relation $V_I' = V_C > V_R$ holds immediately before the heating operation is completed. In other words, the voltage across the diode 49 increases gradually, while the voltage across the diode 51 decreases gradually. Since the leakage current has a similar tendency, the voltage $V_C$ stored in the capacitor 50 is subject to a corresponding variation. If the diode 51 were not provided, the reference voltage $V_C$ stored in the capacitor 50 would decrease according to the time constant determined substantially by the value of leakage current of the diode 49. Such a variation is illustrated by the three-dot chain curve $V_C'$ in FIG. 9.

The above description has clarified the effect of the diode 51 compensating the leakage current of the diode 49. The longer the duration of heating after the storage of the voltage $V_C$ (after the time shown by the arrow A), the compensation effect is more marked. The voltages $V_I'$ and $V_C$ are subject to an abrupt drop at time shown by the arrow B in FIG. 9. This is attributable to the fact that the output voltage of the comparator 52 turns into its low level from its high level at this time. It can thus be seen that the charring detection voltage $V_I$ is divided to provide the voltage $V_R$ utilized for setting the heating completion timing, and this voltage $V_R$ is stored in the capacitor memory circuit composed of the diode 49 and the capacitor 50 which provides the reference voltage $V_C$. In addition, the diode 51 is provided to compensate the leakage current of the diode 49 so as to improve the control performance.

Figure 10:
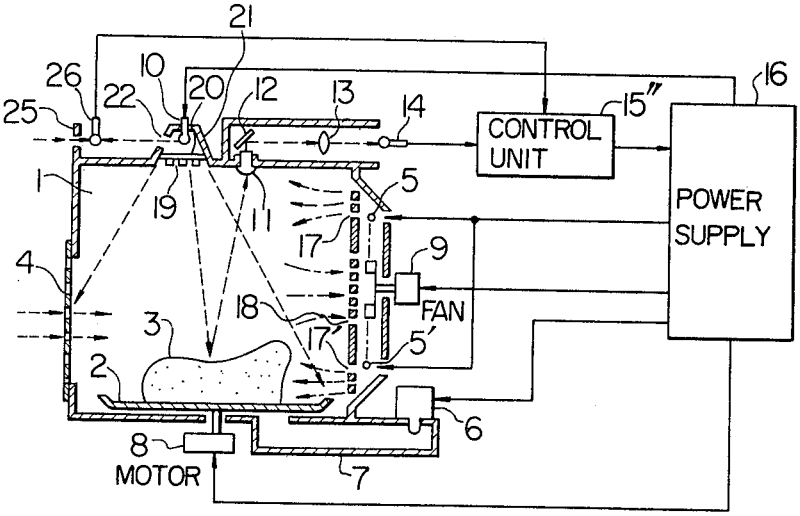
FIG. 10 shows schematically the structure of still another embodiment of the heating apparatus according to the present invention.

FIG. 10 is a schematic sectional view of still another embodiment of the heating apparatus of the present invention which includes a second photo sensor sensing the intensity of light emitted from light source means and also the intensity of external light. In FIG. 10, the same reference numerals are used to designate the same parts appearing in FIG. 1.

Referring to FIG. 10, a second photo sensor 26 senses the intensity of illuminating light emitted from the lamp 10 and, at the same time, senses the intensity of external light. A hole 25 is bored in the side wall of the lamp housing 21 to permit reception of external light by the photo sensor 26. The output signal from the photo sensor 26 is applied to a control unit 15''. Since the structure and operation of the heating apparatus shown in FIG. 10 are generally similar to those of the heating apparatus described with reference to FIGS. 1 and 2, the differences will only be described. The first photo sensor 14 senses the intensity of light reflected from an object 3 to be heated and applies its output signal to the control unit 15''. Similarly, the second photo sensor 26 senses the intensity of illuminating light emitted from the lamp 10 and senses also the intensity of external light to apply such an output signal to the control unit 15''. While compensating variations of the intensity of illunimating light emitted from the lamp 10 and the intensity of external light on the basis of the output signal from the photo sensor 26, the control unit 15'' stores the light intensity signal (the signal indicative of the intensity of light reflected from the object 3) applied from the photo sensor 14 to utilize it for the control of the power supply 16.

Figure 11:
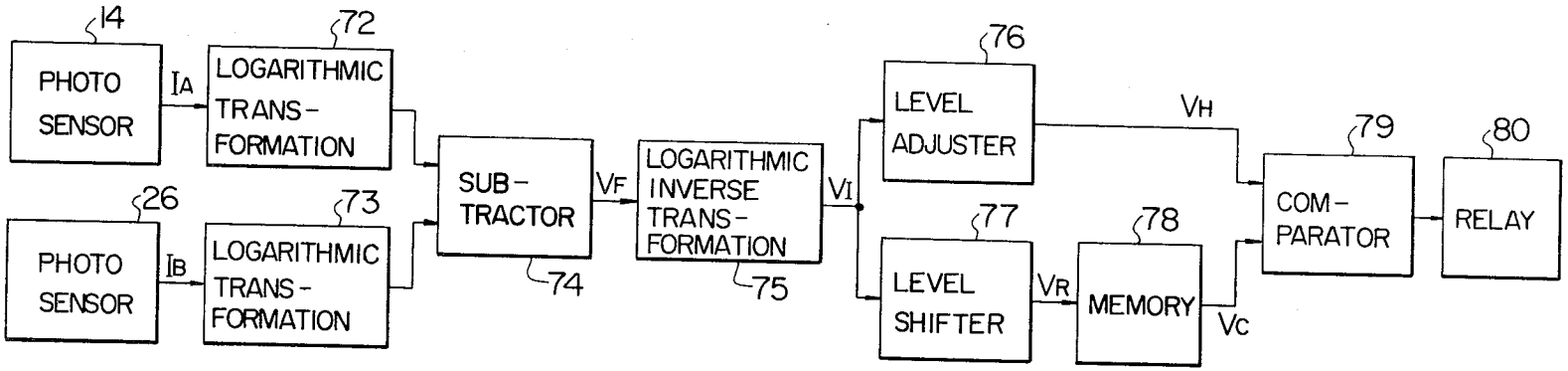
FIG. 11 is a block diagram showing the practical structure of one form of the control unit employed in the heating apparatus of the present invention shown in FIG. 10.

FIG. 11 is a block diagram showing the practical structure of one form of the control unit 15'' shown in FIG. 10. Referring to FIG. 11, the photo sensors 14 and 26 described with reference to FIG. 10 are each in the form of a photo diode provided with a visible light filter. Reference numerals 72 and 73 designate logarithmic transformation sections (logarithmic amplifiers); 74, a subtractor section (a differential amplifier); 75, a logarithmic inverse transformation section (an inverse logarithmic amplifier); 76, a level adjuster section (a potentiometer); 77, a level shifter section (a voltage dividing circuit dividing an input voltage to provide a voltage which is about 75% of the original value); 78, a memory section (a peak holding circuit); 79, a comparator section; and 80, a relay.

The output signals or photocurrents $I_A$ and $I_B$ of the photo sensors 14 and 26 are applied to the logarithmic transformation sections 72 and 73 respectively, and each of these logarithmic transformation sections 72 and 73 transforms the input signal into a logarithmically compressed voltage. The output signals from the logarithmic transformation sections 72 and 73 are applied to the subtractor section 74 which provides an output voltage $V_F$ indicative of the result of subtraction. This output voltage $V_F$ has the following relation with the photocurrents $I_A$ and $I_B$ of the respective photo sensors 14 and 26:

$$V_F \alpha \log I_A - \log I_B = \log (I_A/I_B)$$

where $I_A$ and $I_B$ have the relation $I_A > I_B$.

Such an output voltage $V_F$ is applied from the subtractor section 74 to the logarithmic inverse transformation section 75 which provides an output voltage $V_I$ proportional to the ratio $I_A/I_B$. Thus, the charring detection voltage $V_I$ is obtained which is not affected by variations of the intensity of illuminating light emitted from the lamp 10 and the intensity of external light and which varies in a linear relation with a variation of the intensity of light reflected from the object 3 being heated. The charring detection voltage $V_I$ thus obtained is applied from the logarithmic inverse transformation section 75 to the level adjuster section 76 and to the level shifter section 77. The level adjuster section 76 adjusts the input voltage $V_I$ at the level desired by the user and applies the resultant signal voltage $V_H$ to the comparator section 79. The level shifter section 77 shifts the input voltage $V_I$ to a predetermined level and applies the resultant signal voltage $V_R$ ($\div \frac{3}{4} V_I$, $V_R < V_H$) to the memory section 78. The memory section 78 stores the substantially peak value $V_C$ of the voltage $V_R$ and applies such a voltage $V_C$ to the comparator section 79. The comparator section 79 compares the voltage $V_H$ with the voltage $V_C$. The comparator 79 applies an output signal of high level to the relay 80 when $V_H > V_C$, while it applies an output signal of low level to the relay 80 when $V_H \leqq V_C$. The relay 80 turns on its contact in response to the application of the output signal of high level from the comparator section 79, while it turns off its contact in response to the application of the output signal of low level from the comparator section 79. This contact of the relay 80 is connected to the power supply 16 so that the electric heaters 5, 5', fan 9, motor 8 and lamp 10 can be energized and deenergized as described hereinbefore when the contact of the relay 80 is turned on and off respectively.

The circuit structure shown in FIG. 11 can improve the accuracy of control for the reasons which will now be clarified. In the first place, the output signal from the compensating photo sensor 26 is subtracted from that of the main photo sensor 14 after logarithmic transformation, and the result of subtraction is then subject to logarithmic inverse transformation, so that the effect of compensation by the photo sensor 26 can be represented by the ratio $I_A/I_B$. As a result, the photocurrent output of the photo sensor 14 can be linearly compensated even when the intensity of illuminating light emitted from the lamp 10 and that of external light may vary greatly. Secondly, the level shifting and adjusting section provided by the resistors 44, 47 and potentiometer 45 shown in FIGS. 3 and 7 is divided into the level adjuster section 76 and level shifter section 77 in FIG. 11, so that the voltage $V_R$ stored in the memory section 78 can thereafter be freely varied to vary, as desired, the setting used for the automatic control of charring detection. Also, the function of the diode 51 provided for compensating leakage current of the diode 49 in the memory section, that is, the capacitor memory circuit shown in FIGS. 3 and 7 can be freely selected so as to minimize variations of the reference voltage $V_C$. Although the voltage division ratio of about 75% is employed in the control unit 15'' shown in FIG. 11 since it is satisfactory for the purpose of control, the ratio may be changed to, for example, about 50% so as to compensate both of the leakage current of the capacitor 50 and that of the comparator 52. It can thus be seen that the circuit structure shown in FIG. 11 can satisfactorily compensate variations of the intensity of illuminating light emitted from the lamp 10 and that of external light thereby improving the control performance.

Description will now be directed to the arrangement employed in FIGS. 10 and 11 for detecting charring of the surface of the object 3 being heated while appropriately compensating variations of the intensity of illuminating light emitted from the lamp 10 and that of external light.

Figure 12:
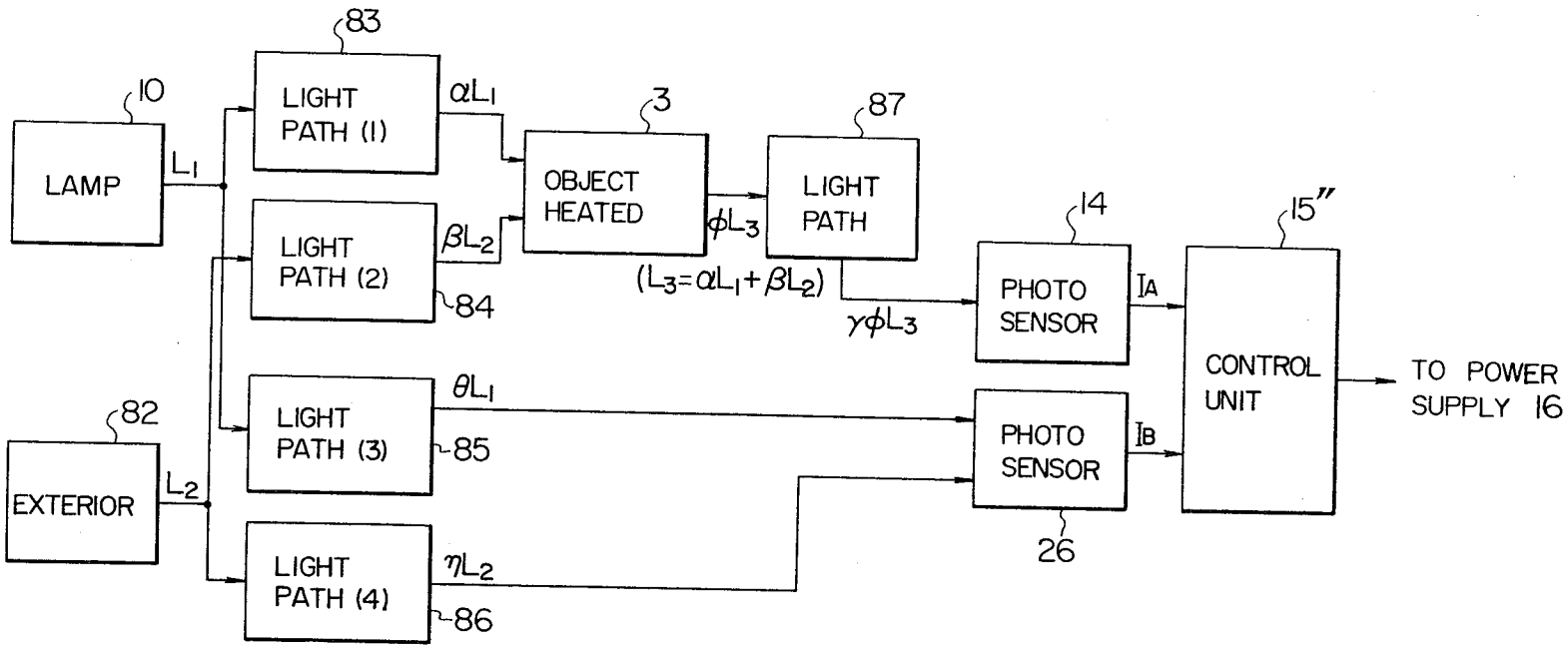
FIG. 12 is a block diagram showing the flows of light and photo signals to illustrate the arrangement employed for attaining matching between the light intensity attenuation factors.

FIG. 12 shows the flows of light and photo signals to illustrate the arrangement employed for attaining matching between the light intensity attenuation factors. Light $L_1$ emitted from the lamp 10 passes through a first light path 83 including the glass sheet 20 and punchings 19 and having an attenuation factor $\alpha$ and passes also through a third light path 85 including the hole 22 bored in the lamp housing 21 and having an attenuation factor $\theta$. Light $L_1$ passing through the first light path 83 is attenuated by the attenuation factor $\alpha$, and light $\alpha L_1$ is directed toward the object 3 being heated. Similarly, light $L_1$ passing through the third light path 85 is attenuated by the attenuation factor $\theta$, and light $\theta L_1$ is directed toward the photo sensor 26. On the other hand, light $L_2$ coming from the exterior 82 of the heating chamber 1 passes through a second light path 84 including the view window of the door 4 and having an attenuation factor $\beta$ and passes also through a fourth light path of 86 including the hole 25 and having an attenuation factor $\eta$. Light $L_2$ passing through the second light path 84 is attenuated by the attenuation factor $\beta$, and light $\beta L_2$ is directed toward the object 3 being heated. Similarly, light $L_2$ passing through the fourth light path 86 is attenuated by the attenuation factor $\eta$, and light $\eta L_2$ is directed toward the photo sensor 26. Light $\alpha L_1$ and light $\beta L_2$ directed onto the object 3 being heated are attenuated by an attenuation factor $\phi$ corresponding to the degree of charring, and reflected light $\phi L_3$ ($L_3 = \alpha L_1 + \beta L_2$) passes through a fifth light path 87 which includes the condenser 11, mirror 12 and lens 13 and has an attenuation factor $\gamma$. Reflected light $\phi L_3$ passing through the fifth light path 87 is attenuated by the attenuation factor $\gamma$, and light $\gamma\phi L_3$ is directed toward the photo sensor 14. The photo sensor 14 converts the light $\gamma\phi L_3$ into the corresponding photocurrent $I_A$, and this signal is applied to the control unit 15''. Similarly, the photo sensor 26 converts the light $\theta L_1$ and light $\eta L_2$ into the corresponding photocurrent $I_B$, and this signal is applied also to the control unit 15''. The photocurrents $I_A$ and $I_B$ are expressed as follows:

$$I_A \alpha\gamma\phi L_3 = \gamma\phi(\alpha L_1 + \beta L_2) = \phi(\alpha\gamma L_1 + \beta\gamma L_2) I_B \alpha\theta L_1 + \eta L_2$$

In order to appropriately detect the attenuation factor $\phi$ which depends upon the degree of charring of the surface of the object 3 being heated, the light paths in the arrangement shown in FIG. 12 are suitably adjusted so as to establish approximately the relations $\theta = \alpha\gamma$ and $\eta = \beta\gamma$. When so adjusted, the arrangement can provide the relation $\phi\alpha I_A/I_B$. In this case, the relation $\gamma\phi L_3 < \theta L_1 + \eta L_2$ holds. That is, the intensity of light incident upon the photo sensor 14 is lower than that of light incident upon the photo sensor 26. Then, the photo sensor 14 was selected to be more sensitive to light than the photo sensor 26, that is, the photo sensor 14 was selected to exhibit a higher photoelectric conversion rate than the photo sensor 26 so as to establish the relation $I_A/I_B < 1$. In connection with the above manner of setting the relation $I_A/I_B < 1$, the control unit 15'' is operated to carry out the steps described with reference to FIG. 11. That is, the output signal $I_B$ from the photo sensor 26 is subtracted from the output signal $I_A$ from the photo sensor 14 after the logarithmic transformation, and then the result of subtraction is subject to the logarithmic inverse transformation to produce an output voltage proportional to the ratio $I_A/I_B$, hence, the charring detection voltage $V_I$. Subsequently, the predetermined value (the peak value) $V_C$ of this voltage $V_I$ is stored in the memory section 78, and, finally, the voltage $V_I$ appearing after the storage of the voltage $V_C$ in the memory section 78 is compared with the voltage $V_C$ stored already in the memory section 78 to attain the desired control. When the control unit 15'' is so operated, the desired control based on the variation of the intensity of light reflected from object 3, hence, the variation of the attenuation factor $\phi$ with the progress of heating operation can be substantially satisfactorily carried out, so that the automatic control described with reference to FIGS. 10 and 11 can be substantially successfully attained. It can be seen from the above description that, by suitably selecting the light paths, photo sensors and control unit, detection of charring of the surface of an object being heated can be automatically controlled while compensating variations of the intensity of illuminating light emitted from the lamp 10 and that of external light. However, all of the above conditions need not necessarily be satisfied, and at least one of these conditions may be satisfied when the photo sensor 26 is specifically adapted to compensate a variation of the intensity of illuminating light emitted from the lamp 10 or the intensity of external light.

Figure 13:
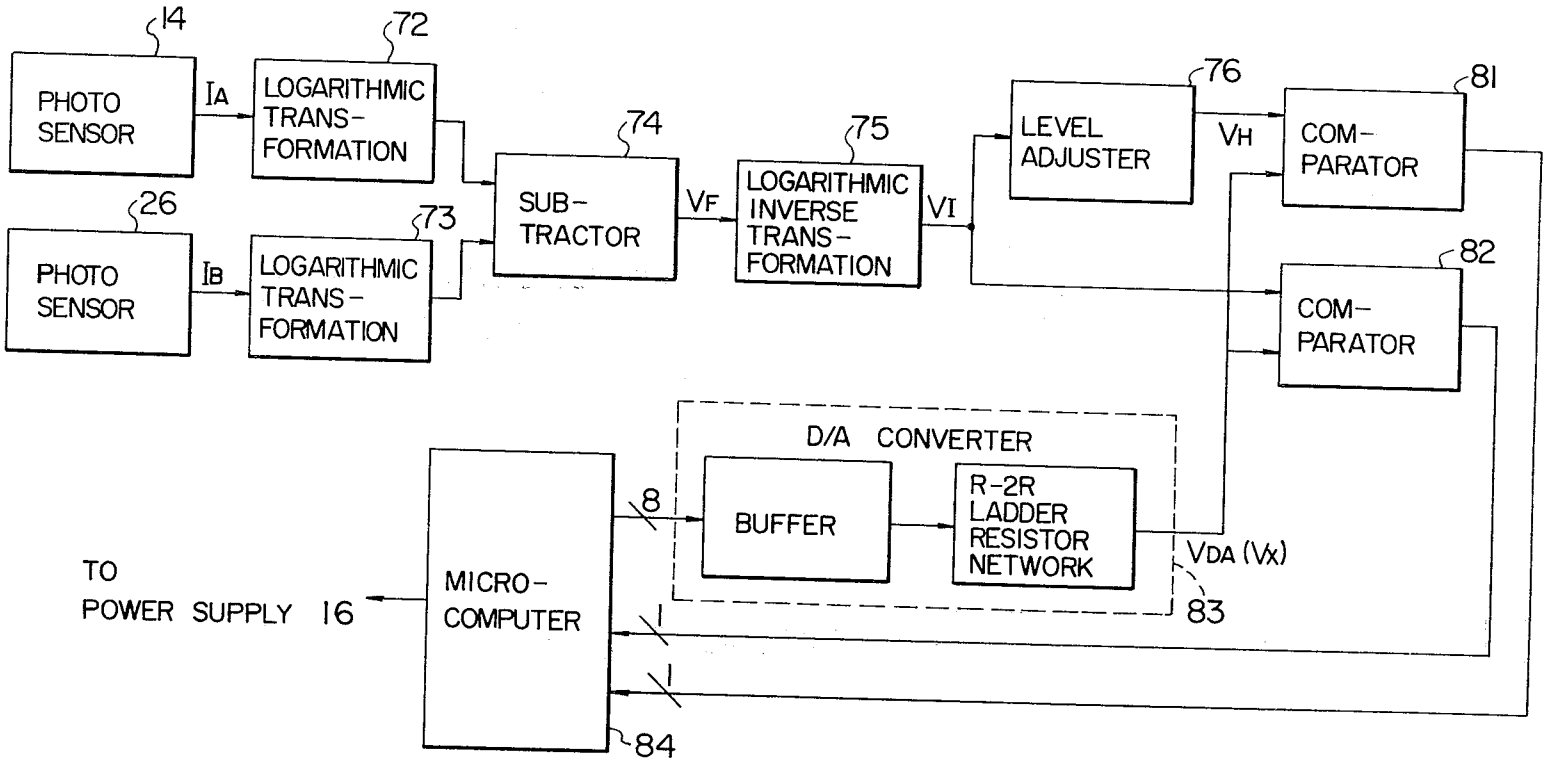
FIG. 13 is a block diagram showing the practical structure of another form of the control unit employed in the heating apparatus of the present invention shown in FIG. 10.
Figure 14:
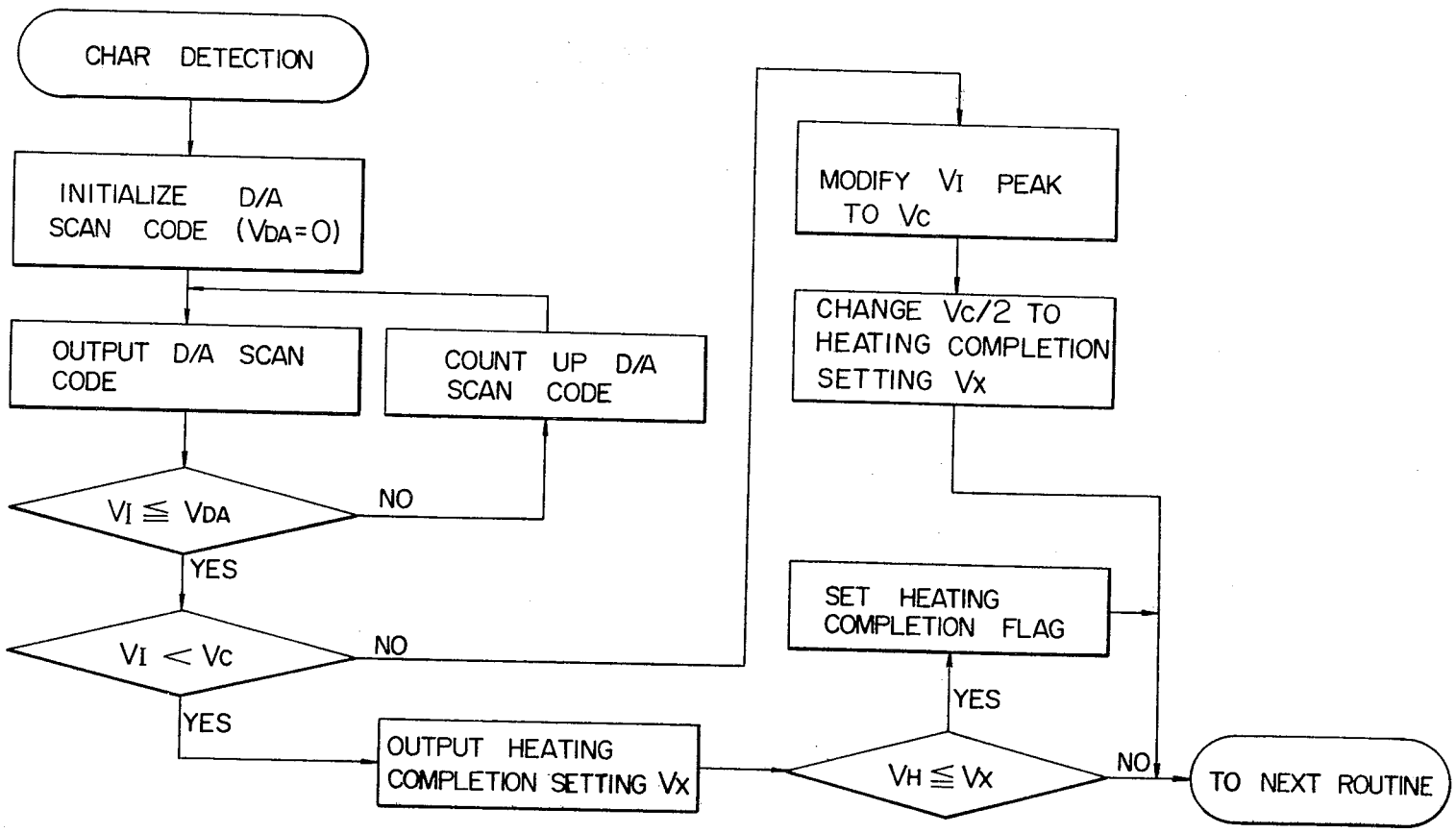
FIG. 14 is a general flow chart showing the steps for detecting charring through processing by the microcomputer shown in FIG. 13.

FIG. 13 is a block diagram showing the practical structure of another form of the control unit 15" shown in FIG. 10, and FIG. 14 is a general flow chart showing the operation of the control unit structure shown in FIG. 13. The control unit 15" shown in FIG. 13 includes a microcomputer 84, and, although there are many input and output blocks except those shown in FIG. 13, only those related directly with the automatic control of detection of charring of the surface of an object 3 to be heated are shown among them to avoid confusion. In FIG. 13, the same reference numerals are used to designate the same parts appearing in FIG. 11.

Referring to FIG. 13, the output signals or photocurrents $I_A$ and $I_B$ of the photo sensors 14 and 26 are applied to the logarithmic transformation sections 72 and 73 respectively, and each of these logarithmic sections 72 and 73 transforms the input signal into a logarithmically compressed voltage. The output signals from these logarithmic transformation sections 72 and 73 are then applied to the subtractor section 74 which provides an output voltage $V_F$ indicative of the result of subtraction. Such an output voltage $V_F$ is applied from the subtractor section 74 to the logarithmic inverse transformation section 75 which provides an output voltage or charring detection voltage $V_I$ proportional to the ratio $I_A/I_B$. The charring detection voltage $V_I$ is applied from the logarithmic inverse transformation section 75 to the level adjuster section 76 and to a comparator section 82. The level adjuster section 76 adjusts the input voltage $V_I$ at the level desired by the user and applies the resultant signal voltage $V_H$ to another comparator section 81. On the other hand, the microcomputer 84 applies an 8-bit code to a D/A converter section 83 so as to read the voltages $V_I$ and $V_H$. The D/A converter section 83 includes a buffer and an R-2R ladder resistor network and provides an analog output voltage $V_{DA}$ or $V_X$ which is applied to the comparator sections 81 and 82. The comparator 81 compares the voltage $V_X$ with the voltage $V_H$, and a 1-bit signal obtained as a result of comparison is applied from the comparator section 81 to the microcomputer 84. Similarly, the comparator section 82 compares the voltage $V_{DA}$ with the voltage $V_I$, and a 1-bit signal obtained as a result of comparison is applied from the comparator section 82 to the microcomputer 84. In this manner, the microcomputer 84 applies sequentially an 8-bit code providing an analog voltage $V_{DA}$ or $V_X$ which is compared with the voltages $V_I$ and $V_H$ so as to read the approximate values of the voltages $V_I$ and $V_H$. The application of the 8-bit code continues until the peak value of the voltage $V_I$, hence, the voltage $V_C$ is detected. By carrying out necessary calculation using this voltage $V_C$, the microcomputer 84 sets the reference value of the voltage $V_X$ which indicates the end of heating. Then, the voltage $V_H$ is compared with the reference voltage $V_X$ until the level of the voltage $V_H$ attains substantially the level of the reference voltage $V_X$, and, at the time at which the voltage $V_H$ attains the level of the reference voltage $V_X$, the microcomputer 84 applies the deenergizing signal to the power supply 16 to complete the heating operation.

The general flow chart of FIG. 14 showing the steps of automatic control for detecting charring of the surface of the object 3 being heated clarifies the operation of the microcomputer 84. In the first step, the D/A scan setting is initialized. That is, an 8-bit code indicative of zero volts is applied from the microcomputer 84 to the D/A converter section 83 to provide the voltage $V_{DA}$ of zero volts. Then, the output signal from the comparator section 82 is read, and the 8-bit code is sequentially counted up until the relation $V_I \leqq V_{DA}$ is established. When the relation $V_I \leqq V_{DA}$ is established, the 8-bit code providing the voltage $V_{DA}$ satisfying the above relation is compared with the 8-bit code having been applied to provide the peak voltage $V_C$ before establishment of the relation $V_I \leqq V_{DA}$. When the result of comparison indicates that $V_I \geqq V_C$, the code providing such a voltage $V_C$ is modified into the code providing the voltage $V_I$, and the code providing the new value of the voltage $V_C$ is shifted by one bit position toward the right to obtain the code providing the value $V_C/2$ so as to use it as the code providing the heating completion setting $V_X$. When, on the other hand, the result of comparison teaches that $V_I < V_C$, the code providing the voltage $V_X$ is applied to the D/A converter section 83. Then, the output signal from the comparator section 81 is read, and the flag indicating completion of the heating operation is set as soon as the relation $V_H \leqq V_X$ is established. In another processing routine, the setting of this flag is checked or confirmed so as to apply the deenergizing signal to the power supply 16. It can be seen that employment of the circuit structure shown in FIG. 13 can also improve the control performance by compensation of variations of the intensity of illuminating light emitted from the lamp 10 and that of external light.

It will be understood from the foregoing detailed description that the present invention can provide a heating apparatus operable with improved control performance by virtue of the unique arrangement in which the first photo sensor 14 senses the intensity of light of visible spectrum range reflected from the surface of an object 3 being heated, and the second photo sensor 23, 24, 26 senses the intensity of other light affecting the intensity of light reflected from the surface of the object 3, that is, at least one of the intensity of illuminating light emitted from the lamp 10 and the intensity of external light entering the heating chamber 1, so that the degree of charring of the surface of the object 3 being heated can be reliably judged or discriminated to control the heating operation on the basis of the output signals from these photo sensors.

Further, in an embodiment of the present invention, the output signal from the second photo sensor 23, 24, 26 is subtracted from the output signal from the first photo sensor 14 after logarithmic transformation, and the result of subtraction is then subject to logarithmic inverse transformation, so that the light intensity variations can be compensated on the basis of the ratio $I_A/I_B$ thereby improving the control performance.

In still another embodiment of the present invention, the switching element or diode 51 is provided to compensate the leakage current of the semiconductor switching element or diode 49 supplying current to the capacitor 50 in the capacitor memory circuit, thereby improving the control performance.

The control performance can also be improved because of the fact that the path of light 85 or hole 22 for leading illuminating light emitted from the lamp 10 toward the second photo sensor 23, 24, 26 and the path of light 86 or hole 25 for leading external light toward the second photo sensor 23, 24, 26 are provided in addition to the path 83 of illuminating light emitted from the lamp 10 to be directed toward an object 3 being heated, the path 84 of external light entering the heating chamber 1 to be incident upon the object 3, and the path 87 of light reflected from the object 3 to be directed toward the first photo sensor 14, so as to attain matching of the light intensity attenuation factors of these light paths.

In the embodiment of the present invention shown in FIGS. 2 and 3, the second photo sensor 23 is in the form of a photo diode which exhibits its maximum sensitivity generally in the infrared region of the spectrum. However, employment of such a photo diode is not encountered with any substantial problem since, when the light source or lamp 10 is, for example, a tungsten lamp, the intensity of light including the visible range and infrared range of the spectrum varies substantially linearly until the AC voltage applied across the lamp 10 is reduced to an extremely low level.

Further, the present invention is also equally effective when the operational amplifiers 28 and 32 are selected to exhibit the same output characteristic with respect to the intensities of illuminating light emitted from the lamp 10 and external light respectively, and the reference voltage of, for example, the capacitor memory circuit is selected to be a negative voltage instead of zero volts. For example, the desired control can be equally effectively attained even when the grounded ends of the capacitor 50 and resistor 47 are connected to a negative power supply terminal.

What is claimed is:

1. A heating apparatus comprising:

a heating chamber;

heating means capable of heating an object to be heated in said heating chamber until a surface of said object is charred to a given extent;

light source means for emitting light of visible spectrum range to illuminate the surface of said object placed in said heating chamber;

first photo sensor means for sensing the intensity of light reflected from the surface of said object;

second photo sensor means for sensing the intensity of light illuminating the surface of said object as at least one of the intensity of light emitted from said light source means and the intensity of external light entering said heating chamber;

means responsive to responsive outputs from said first and second sensor means for judging the degree of charring of the surface of said object, said judging means including means for compensating an output from said first photo sensor means on the basis of an output from said second photo sensor means, said compensating means including means for subjecting the output from said first photo sensor means and the output from said second photosensor means to logarithmic transformation, means for subtracting the result of logarithmic transformation of the latter output from the result of logarithmic transformation of the former output, and means for subjecting the result of subtraction to logarithmic inverse transformation; and means responsive to an output from said judging means for controlling the heating operation of said heating means.

2. A heating apparatus comprising:

a heating chamber;

heating means capable of heating an object to be heated in said heating chamber until a surface of said object is charred to a given extent;

light source means for emitting light of visible spectrum range to illuminate the surface of said object placed in said heating chamber;

first photo sensor means for sensing the intensity of light reflected from the surface of said object;

second photo sensor means for sensing the intensity of light illuminating the surface of said object as at least one of the intensity of light emitted from said light source means and the intensity of external light entering said heating chamber;

means responsive to responsive outputs from said first and second sensor means for judging the degree of charring of the surface of said object, said judging means including means for compensating an output from said first photo sensor means on the basis of an output from said second photo sensor means, said judging means further includes memory means receiving an compensated output from said first photo sensor means for storing the value of said output appearing in the initial stage of heating, comparing means receiving the compensated output from said first photo sensor means for comparing said compensated output varying with the progress of heating with said output value stored in said memory means and applying the compared output value to said control means as an output indicative of the judged degree of charring of the surface of said object; and means responsive to an output from said judging means for controlling the heating operation of said heating means.

3. A heating apparatus comprising:

a heating chamber;

heating means capable of heating an object to be heated placed in said heating chamber until a surface of said object is charred to a given extent;

light source means for emitting light of visible spectrum range to illuminate the surface of said object placed in said heating chamber;

first photo sensor means for sensing the intensity of light reflected from the surface of said object;

second photo sensor means for sensing the intensity of light emitted from said light source means;

means responsive to respective outputs from said first and second sensor means for judging the degree of charring of the surface of said object, said judging means including memory means receiving an output from said first photo sensor means for storing the value of said output appearing in the initial stage of heating, comparing means receiving the output from said first photo sensor means for comparing said output varying with the progress of heating with said output value stored in said memory means, and compensating means for compensating the output from said comparing means in response to an output from said second photo sensor means and applying the compensated value to said control means as an output indicative of the judged degree of charring of the surface of said object; and means responsive to an output from said judging means for controlling the heating operation of said heating means.

4. A heating apparatus as claimed in claim 3, wherein said compensating means includes means for subjecting the output from said first photo sensor means and the output from said second photo sensor means to logarithmic transformation, means for subtracting the result of logarithmic transformation of the latter output from the result of logarithmic transformation of the former output, and means for subjecting the result of subtraction to logarithmic inverse transformation.

5. A heating apparatus as claimed in claim 3, wherein said memory means is in the form of capacitor memory circuit means including a capacitor and a switching element supplying, in response to the output from said first photo sensor means, a current corresponding to said output of said first photo sensor means to said capacitor, and wherein said judging means further includes leakage current compensating means for compensating at least a leakage current of said switching element.

6. A heating apparatus as claimed in claim 3, further comprising first light path means for leading light emitted from said light source means toward said object being heated, second light path means for leading light reflected from the surface of said object toward said first photo sensor means, and third light path means for leading light of the light intensity related to the light illuminating the surface of said object toward said second photo sensor means, said third light path means having an attenuation factor matching with those of said first and second light path means.

7. A heating apparatus comprising:

a heating chamber;

heating means capable of heating an object to be heated placed in said heating chamber until a surface of said object is charred to a given extent;

light source means for emitting light of visible spectrum range to illuminate the surface of said object placed in said heating chamber;

first photo sensor means for sensing the intensity of light reflected from the surface of said object;

second photo sensor means for sensing the light intensity of external light entering said heating chamber;

means responsive to respective outputs from said first and second sensor means for judging the degree of charring of the surface of said object, said judging means includes memory means receiving an output from said first photo sensor means for storing the value of said output appearing in the initial stage of heating, comparing means receiving the output from said first photo sensor means for comparing said output varying with the progress of heating with said output value stored in said memory means, and compensating means for compensating the output from said comparing means in response to an output from said second photo sensor means and applying the compensated value to said control means as an output indicative of the judged degree of charring of the surface of said object; and means responsive to an output from said judging means for controlling the heating operation of said heating means.

8. A heating apparatus as claimed in claim 7, wherein said compensating means includes means for subjecting the output from said first photo sensor means and the output from said second photo sensor means to logarithmic transformation, means for subtracting the result of logarithmic transformation of the latter output from the result of logarithmic transformation of the former output, and means for subjecting the result of subtraction to logarithmic inverse transformation.

9. A heating apparatus as claimed in claim 7, wherein said memory means is in the form of capacitor memory circuit means including a capacitor and a switching element supplying, in response to the output from said first photo sensor means, a current corresponding to said output of said first photo sensor means to said capacitor, and wherein said judging means further includes leakage current compensating means for compensating at least a leakage current of said switching element.

10. A heating apparatus as claimed in claim 7, further comprising first light path means for leading light emitted from said light source means toward said object being heated, second light path means for leading light reflected from the surface of said object toward said first photo sensor means, and third light path means for leading light of the light intensity related to the light illuminating the surface of said object toward said second photo sensor means, said third light path means having an attenuation factor matching with those of said first and second light path means.

11. A heating apparatus as claimed in claim 7, wherein said second sensing means further senses the intensity of light emitted from said light source means.

* * * * *